United States Patent [19]

Little

[11] Patent Number: 4,522,571

[45] Date of Patent: Jun. 11, 1985

[54] PERISTALTIC PUMP

[76] Inventor: Robert K. Little, 519 Jacksonville Rd., Mt. Holly, N.J. 08060

[21] Appl. No.: 586,195

[22] Filed: Mar. 5, 1984

[51] Int. Cl.[3] ..... F04B 43/12

[52] U.S. Cl. ..... 417/476

[58] Field of Search ..... 417/474, 475, 476, 477; 418/45

[56] References Cited

U.S. PATENT DOCUMENTS

| | | | |
|---|---|---|---|
| 3,180,272 | 4/1965 | Broadfoot | 417/475 X |
| 3,674,383 | 7/1972 | Iles | 417/476 |
| 3,723,030 | 3/1973 | Gelfand | 417/475 |
| 4,392,794 | 7/1983 | Foxcroft | 417/477 X |

FOREIGN PATENT DOCUMENTS

| | | | |
|---|---|---|---|
| 785546 | 12/1980 | U.S.S.R. | 417/474 |
| 794246 | 1/1981 | U.S.S.R. | 417/476 |

*Primary Examiner*—Richard E. Gluck
*Attorney, Agent, or Firm*—Richard D. Weber

[57] ABSTRACT

A peristaltic pump having a single pumping roller mounted on an eccentric portion of a drive shaft for compression of an elastomeric tube wrapped at least one revolution therearound. The peripheral surface of the roller around which the tube is disposed comprises a frusto-conical surface. A tube compressor includes a central bore having a frusto-conical surface coaxial with the drive shaft and corresponding to the surface of the roller. Means are provided for selectively adjusting the axial position of the tube compressor to either increase or decrease the degree to which the tube is compressed upon rotation of the roller, thereby providing selective control of the output pressure of the pump. The output of the pump may be selectively varied by variation of the speed of the drive shaft.

11 Claims, 4 Drawing Figures

PERISTALTIC PUMP

BACKGROUND OF THE INVENTION

The present invention relates generally to a peristaltic pump construction and relates more particularly to a peristaltic pump wherein both the pump output as well as the pump output pressure can be selectively and independently varied.

In the conventional form of peristaltic pump, the elastomeric tube through which the fluid is pumped is engaged by one or more rollers, the path of which is fixed with respect to the arcuate or annular tube support. In such a pump construction, the pump output may be varied by changing the speed at which the pump rollers are driven, but the pump pressure remains essentially constant. Such pumps accordingly have limited flexibility of operation and are not suited for applications wherein pump output pressure must be controlled.

SUMMARY OF THE INVENTION

The present invention provides a peristaltic pump construction which permits the selective independent control of the pump output pressure as well as the pump output. The pump includes a single pumping roller mounted on an eccentric portion of a drive shaft. The peripheral surface of the roller comprises a frusto-conical surface around which an elastomeric tube is wrapped for at least one revolution. A tube compressor overlies the roller and tube and includes a central bore having a frusto-conical surface coaxial with the drive shaft and corresponding to the surface of the roller. Means are provided for selectively adjusting the axial position of the tube compressor to either increase or decrease the degree to which the tube is compressed upon rotation of the roller, thus providing selective control of the output pressure of the pump. The output of the pump may be selectively varied by variation of the speed of the drive shaft, which is preferably driven by a variable speed motor.

It is accordingly a primary object of the invention to provide a peristaltic pump which permits the selective independent control of both the pump output and the pump output pressure.

Another object of the invention is to provide a pump as described of a relatively simple construction having few moving parts and which can be economically manufactured.

Additional objects and advantages of the invention will become evident from the following detailed description of an embodiment thereof.

DESCRIPTION OF THE PREFERRED EMBODIMENT

Figure 1:
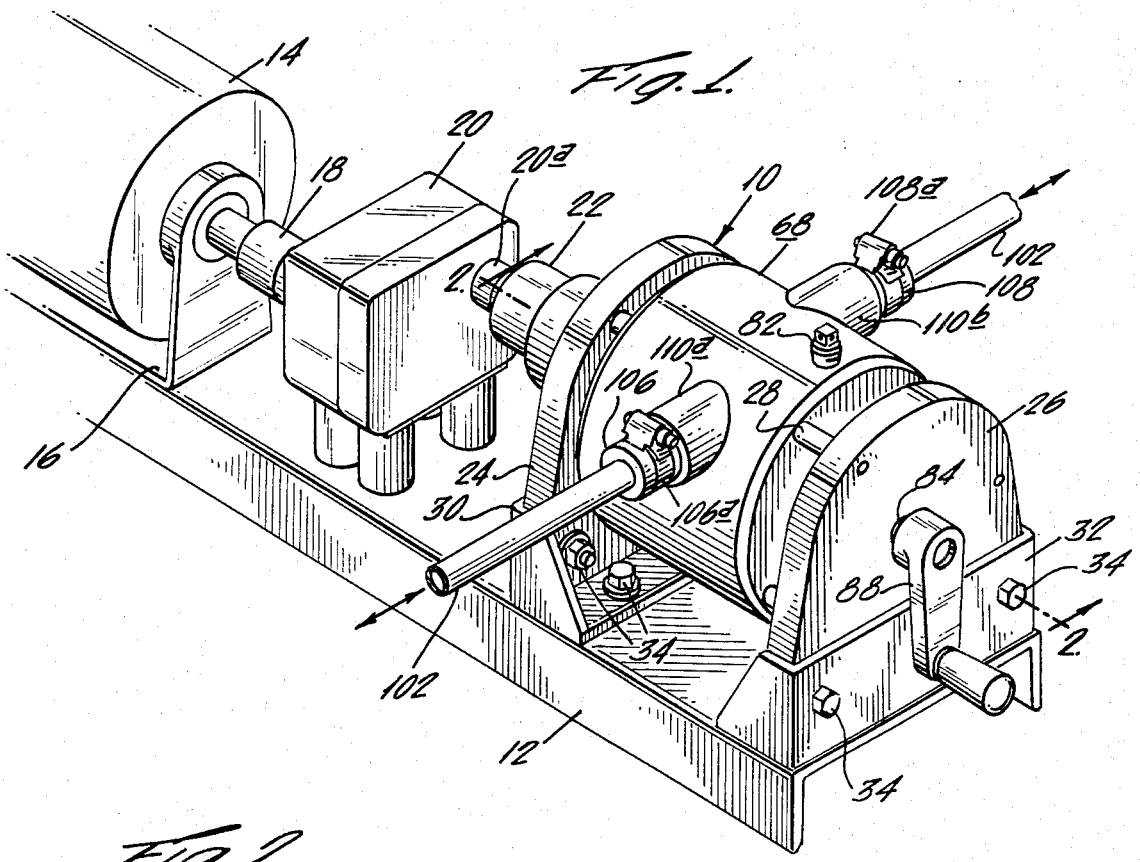
FIG. 1 is a perspective view showing a pump in accordance with the present invention connected to an electric motor by means of a reduction gear unit.

Referring to the drawings, and particularly FIG. 1 thereof, a peristaltic pump 10 in accordance with the present invention is shown mounted on a channel shaped frame 12. An electric motor 14 is mounted on the frame 12 by means of mounting bracket 16 and is connected by coupler 18 with the reduction gear unit 20 which in turn is connected by coupling 22 to the pump 10. The motor 14 is preferably a reversible variable speed motor to permit selective control of the direction and output of the pump.

Figure 2:
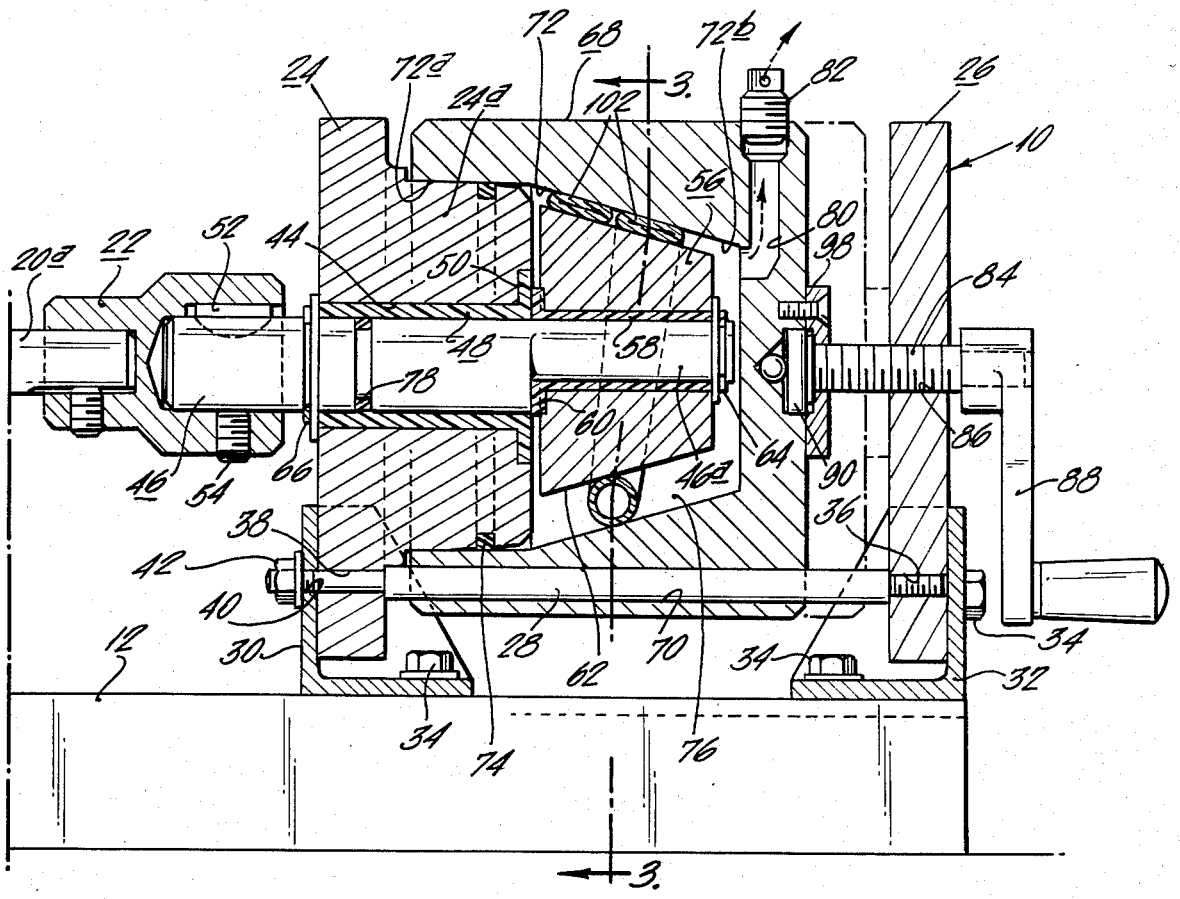
FIG. 2 is a sectional view taken along line 2—2 of FIG. 1 with the pump adjusted to produce a maximum output pressure.
Figure 3:
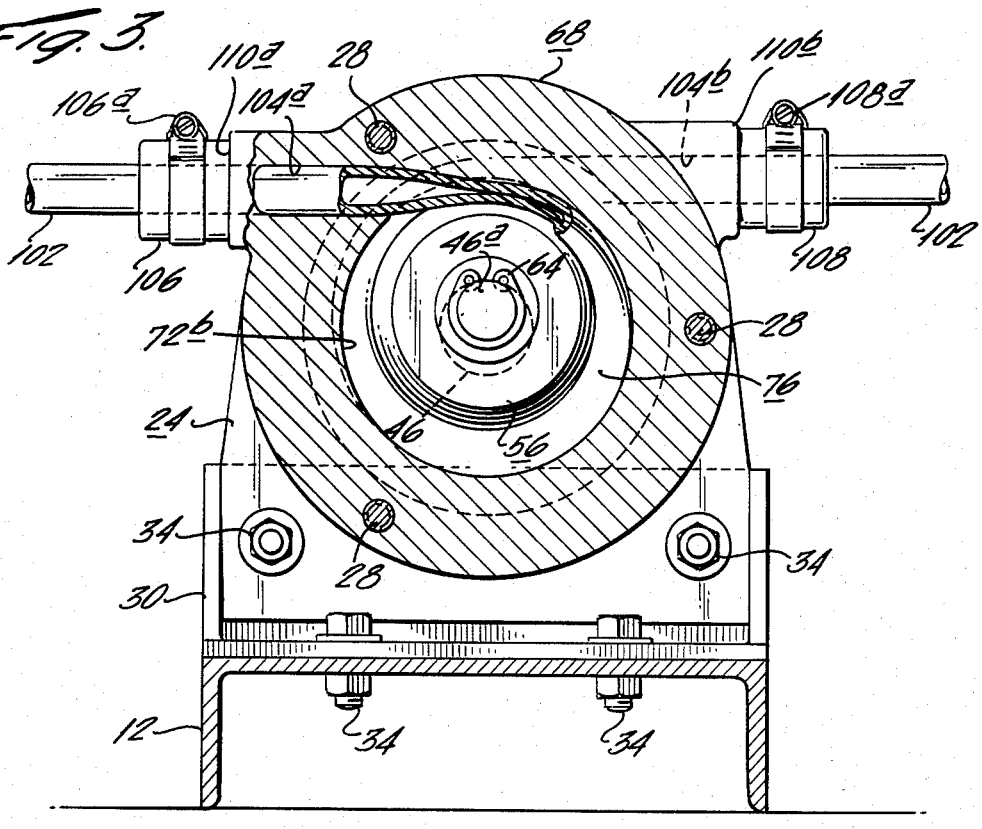
FIG. 3 is a sectional view taken along line 3—3 of FIG. 2.
Figure 4:
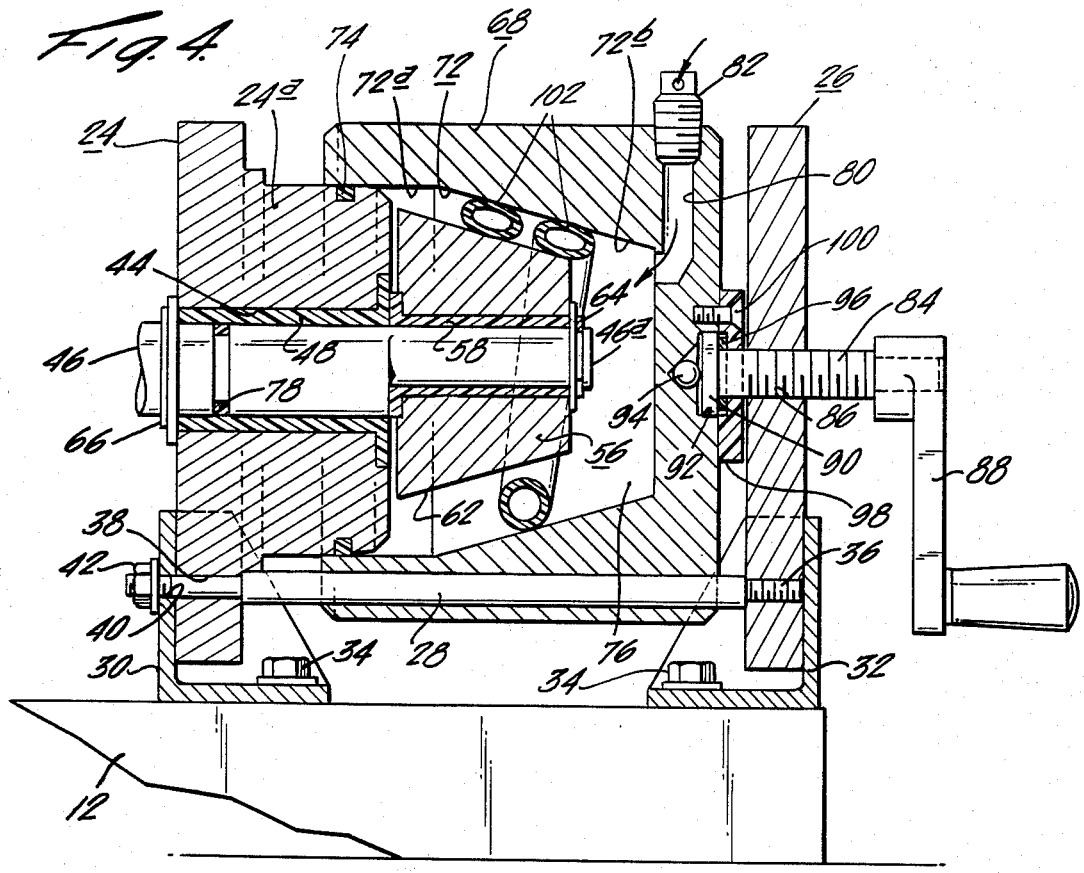
FIG. 4 is a view similar to FIG. 2 but showing the pump adjusted to produce a minimum output pressure.

As shown most clearly in FIGS. 2–4, the pump 10 comprises an upstanding base member 24 and a spaced opposed end plate 26 parallel thereto, the base member 24 and end plate 26 being secured in spaced relation by a plurality of parallel tie rods 28. The tie rods 28 are spaced in a circular pattern and each include threaded end portions of reduced diameter which permit connection to the base member 24 and end plate 26 either by cooperation with internal threaded bores in those elements or by passage through suitable bores for securing by nuts on the extending ends.

In the embodiment shown, the base member 24 and end plate 26 are respectively secured to the upper surface of the frame 12 by mounting brackets 30 and 32. Bolts 34 are employed to secure the base member, end plate and brackets 30 and 32 together and to the frame 12. Alternatively, base member 24 and end plate 26 could be provided with flanges to permit direct bolting to the frame, or, for a more permanent installation, the end plate and base member could be directly welded to the frame.

The tie rod 28 which appears in FIG. 2 is threadedly connected at its right hand end with a threaded bore 36 in the end plate 26 and, at its opposite end, passes through a bore 38 in the base member 24, and aligned bore 40 in the bracket 30, and is secured in place by means of nut 42. Similar connecting arrangements are employed with the other tie rods. Although three tie rods 28 are illustrated, and are equally spaced as shown in FIG. 3, a different number of tie rods could be employed if desired.

The base member 24 includes an inwardly projecting generally cylindrical portion **24*a*. A central bore 44 in the base member 24 concentric with the cylindrical portion 24*a* rotatably supports the pump drive shaft 46 by means of the intermediate sleeve bearing 48. The bearing 48 includes a radial flange at its inner end and the cylindrical portion 24*a* of the base member 24 is counterbored to receive the flange 50. The pump shaft 46 extends outwardly beyond the base member 24 and is secured by key 52 and set screw 54 to the coupling 22 and shaft 20*a* of the reduction unit 20. The pump drive shaft 46 is accordingly driven by the motor 14**.

An eccentric portion **46*a* of the drive shaft 46 extends inwardly beyond the inner face of the cylindrical portion 24*a*. A roller 56 is rotatably mounted on the eccentric drive shaft portion 46*a* by means of sleeve bearing 58 passing through a central bore therein. A flange portion 60 of the bearing 58 extends radially at the end of the bearing proximate the flange portion 50 of bearing 44 for sliding engagement therewith. The flange portion 60 of bearing 58 is only partly recessed into the roller 56 and thereby serves to space the roller 56 from the cylindrical portion 24*a*. The outer surface 62 of the roller 56 is of a frusto-conical configuration with the smaller diameter end innermost. The roller 56 is secured on the drive shaft by a snap ring 64 on the extending end of the eccentric shaft portion 46*a*. A snap ring 66 disposed in a slot in the outwardly extending portion of the shaft 46 positions the shaft axially with respect to the base member 24**.

A tube compressor 68 having a generally cylindrical shape includes a plurality of parallel bores 70 through which pass the tie rods 28. The bores 70 are sized to permit the sliding movement of the tube compressor along the tie rods. The tube compressor includes a central hollow axial bore 72 having a cylindrical portion 72*a* adjacent the open end thereof which is dimensioned to slidably cooperate with the cylindrical surface of the cylindrical portion 24*a* of end plate 24. The bore 72 is coaxial with the drive shaft 46 and cylindrical portion 24*a* of the base member 24. The inner end of the bore 72 comprises a frusto-conical shaped portion 72*b*, the wall of which, considered along any radial plane, is parallel with and spaced from the frusto-conical surface 62 of the roller 56. An O-ring 74 disposed in a slot of the cylindrical portion 72*a* cooperates with the cylindrical surface 72*a* of the tube compressor to provide a sealed condition of the chamber 76 formed by the bore portion 72*b* and the cylindrical portion 24*a*. The sealing of this chamber is augmented by the provision of an O-ring seal 78 in a suitable slot in shaft 46 within the bearing 44. Pressure relief for the chamber 76 is provided by outlet passage 80 in the wall of the tube compressor 68, which in the embodiment illustrated is provided with a pressure relief plug 82.

The axial position of the tube compressor 68 is controlled by an adjusting screw 84 passing through a threaded bore 86 in the end plate 26. The screw 84 is selectively rotated by a crank 88 to effect axial movement of the screw and connected tube compressor. The inner end of the screw 84 as shown in FIG. 4 is secured to a bearing plate 90 disposed within a bore 92 of the tube compressor. The bearing plate 90 engages a ball bearing 94 set within a tapered extension of the counterbore 92 to transfer inwardly directed screw forces to the tube compressor. Outwardly directed screw forces are directed against a bearing ring 96 of retainer plate 98 secured to the end of the tube compressor by a plurality of screws 100. By means of the described mechanism, rotation of the crank 88 produces a selective movement of the tube compressor 68 axially along the tie rods 28.

As shown in FIGS. 1 and 3, a tube 102 formed from elastomeric tubing passes into and out of the chamber 76 through the wall of the tube compressor 68 which is provided with opposed bores 104*a* and 104*b* for this purpose disposed in essentially tangential alignment to the chamber wall. Sleeves 106 and 108 bonded to the shoulders 110*a* and 110*b* of the tube compressor, are secured to the tube by clamps 106*a* and 108*a* to prevent movement of the tube into the chamber 76.

For operation, the tube 102 is connected at one end to a source of the material to be pumped and at its other end to the conduit or vessel through or into which the material is to be directed. Since the pump can operate in either direction, it does not matter which end of the tube is connected with the material source. With the motor 14 connected to a power source, the pump is ready for operation.

Energization of the motor effects a rotation of the pump drive shaft 46. The roller 56 rotatably mounted on the eccentric drive shaft portion 46*a* moves through an eccentric path within the chamber 76 to effect a peristaltic pumping action on the tube 102. The roller 56 rotates on the eccentric shaft portion in a direction opposite the direction of rotation of the shaft as the roller rolls along and compresses the tube. Utilizing a variable speed motor as preferred, the speed of rotation of the pump drive shaft can be selectively controlled to effect variation in the pump output. With a reversible motor, the pump can be operated in either direction.

The output pressure of the pump is controlled by varying the degree to which the tube 102 is compressed by the roller as it moves around the chamber 76. The degree of tube compression may be selectively varied by changing the axial position of the tube compressor 68 by rotation of the handle 88 and shaft 84. To increase the pump output pressure, the tube compressor is moved to the left as viewed in FIGS. 2 and 4. Such movement decreases the spacing between the frusto-conical surfaces of the roller and the tube compressor with a consequent increased flattening of the tube disposed therebetween. The maximum output pressure is obtained when the tube compressor is moved to the leftward position shown in FIG. 2 which completely closes the tubing.

A minimum pumping pressure is obtained when the tube compressor is in the position of FIG. 4 wherein the tube compressor has been moved substantially to the right as compared with the position of FIG. 2. In the position of FIG. 4, there is a minimal deformation of the tube by the roller and the output pressure of the pump is consequently reduced. Since the tube compressor can be set at any axial position between the fully open tube position and the fully closed tube position, the output pressure of the pump is accordingly infinitely variable from a zero output pressure to the maximum pressure rating of the tubing. The output of the pump may be varied independently of the pressure by changing the speed of rotation of the pump drive shaft 46, an increased speed producing an increased output. The pump output/pressure curve may thus take any desired shape to suit a particular application in view of the independently controllable pressure and output of the pump.

The chamber 76 is preferably sealed such as by means of the O-rings 74 and 78 to prevent loss of the pumped fluid materials in the event of failure of the tubing within the pump. The bonding of the sleeves 106 and 108 to the shoulders 110*a* and 110*b* further prevents fluid loss in case of tube leakage. However, in order to permit movement of the tube compressor, some form of pressure relief within the chamber 76 is necessary, especially if the chamber is to be fluid filled as may be desirable in some circumstances. For this purpose, an outlet passage 80 is provided which may be connected with a source of fluid at a controlled pressure. In the illustrated embodiment, the pressure relief fitting 82 maintains atmospheric pressure within the chamber 76.

It is essential that the tube 102 extend at least 360° around the roller 56 to insure that the roller will be actively deforming the tube at some point at all times. Otherwise the tube would open fully and the material advanced could retreat into the region from which it had just been moved, negating any pumping action. The tube may extend around the roller for more than one revolution, and in fact several revolutions could be employed if desired.

Although in the illustrated embodiment the tube compressor position is controlled by a screw 84 in end plate 26, other means can be employed to carry out this function such as fluid-actuated cylinders, electric linear actuators, etc. Furthermore, such means need not be based on the end plate, but could extend directly from the bore member 24.

The present pump construction in addition to the unique features described above retains the many advantages inherent in a peristaltic pump including the absence of any contact of the pumped fluid with the working parts of the pump, the permissible operation of the pump in either direction, and the permissible selection of a variety of tubing materials to suit the nature of the pumped material. Not only can a peristaltic pump be utilized with difficult to handle materials such as corrosive and abrasive fluids, but it is also well suited for use in sanitary applications, utilizing a suitable type of sanitary tubing.

Manifestly, changes in details of construction can be effected by those skilled in the art without departing from the invention.

I claim:

1. A peristaltic pump comprising a base member, said base member including a cylindrical portion extending therefrom, a shaft rotatably mounted in said base member concentric with said cylindrical portion, an eccentric portion of said shaft extending beyond said base member cylindrical portion, a roller rotatably mounted on said shaft eccentric portion, the peripheral surface of said roller having a frusto-conical configuration, an elastomeric tube disposed around said roller peripheral surface to form at least one full revolution therearound, a tube compressor, said tube compressor having a bore therein coaxial with said base member cylindrical portion, a portion of said tube compressor bore being cylindrical and overlying said base member cylindrical portion in slidable relation therewith, means for selectively controlling the axial position of said tube compressor with respect to said base member, said tube compressor bore continuing inwardly from said cylindrical portion in a frusto-conical portion parallel to and spaced from the frusto-conical peripheral surface of said roller, said tube compressor being selectively axially positionable to effect a deformation of said tube between the frusto-conical surfaces of said roller and said tube compressor, the rotation of said shaft causing an eccentric path of movement of said roller to effect a peristaltic pumping action on the contents of said tube, the output pressure of the pump being selectively variable and dependent upon the axial positioning of said tube compressor.

2. The invention as claimed in claim 1 wherein said means for selectively controlling the axial position of said tube compressor is adjustable to any desired position between and including a fully opened tube position and a fully closed tube position.

3. The invention as claimed in claim 1 wherein said base member and said tube compressor cooperate to form a closed chamber within which the tube and roller are disposed.

4. The invention as claimed in claim 3 wherein said chamber is sealed, and wherein means are provided to control the pressure within said sealed chamber.

5. The invention as claimed in claim 1 including means for rotating said shaft.

6. The invention as claimed in claim 5 wherein said means for rotating said shaft comprises a variable speed electric motor.

7. The invention as claim in claim 1 including bores in said frusto-conical wall of said tube compressor for passage of the tube.

8. The invention as claimed in claim 7 wherein said bores in said tube compressor frusto-conical wall are arranged in substantially tangential relation to said wall in opposed directions.

9. A peristaltic pump comprising a base member, said base member including a cylindrical portion extending therefrom, a shaft rotatably mounted in said base member concentric with said cylindrical portion, an eccentric portion of said shaft extending beyond said base member cylindrical portion, a roller rotatably mounted on said shaft eccentric portion, the peripheral surface of said roller having a frusto-conical configuration, an elastomeric tube disposed around said roller peripheral surface to form at least one full revolution therearound, a tube compressor, said tube compressor having a bore therein coaxial with said base member cylindrical portion, a portion of said tube compressor bore being cylindrical and overlying said base member cylindrical portion in slidable relation therewith, an end plate disposed in spaced relation to said base member opposite said cylindrical portion thereof, a plurality of spaced, parallel tie rods connecting said end plate with said base member, bores in said tube compressor for receiving said tie rods to permit sliding movement of said tube compressor axially therealong, means on said end plate for selectively controlling the axial position of said tube compressor with respect to said base member, said tube compressor bore coaxial with said base member cylindrical portion continuing inwardly from said bore cylindrical portion to a frusto-conical portion parallel to and spaced from the frusto-conical peripheral surface of said roller, said tube compressor being selectively axially positionable to effect a deformation of said tube between the frusto-conical surfaces of said roller and said tube compressor, the rotation of said shaft causing an eccentric path of movement of said roller to effect a peristaltic pumping action on the contents of said tube, the output pressure of the pump being selectively variable and dependent upon the axial position of said tube compressor.

10. The invention claimed in claim 9 wherein said means on said end plate for selectively controlling the axial position of said tube compressor comprises screw means passing through said end plate and operatively connected with said tube compressor, and means for selectively rotating said screw means.

11. The invention claimed in claim 10 wherein said means for selectively rotating said screw means comprises a crank.

* * * * *